US010056093B2

(12) United States Patent
Kamino

(10) Patent No.: US 10,056,093 B2
(45) Date of Patent: Aug. 21, 2018

(54) ENCODING DEVICE, DECODING DEVICE, AND COMMUNICATION SYSTEM FOR EXTENDING VOICE BAND

(71) Applicant: JVC KENWOOD Corporation, Yokohama-shi, Kanagawa (JP)

(72) Inventor: Ryo Kamino, Yokohama (JP)

(73) Assignee: JVC KENWOOD Corporation, Yokohama-shi (JP)

( * ) Notice: Subject to any disclaimer, the term of this patent is extended or adjusted under 35 U.S.C. 154(b) by 0 days.

(21) Appl. No.: 15/481,874

(22) Filed: Apr. 7, 2017

(65) Prior Publication Data

US 2017/0330584 A1 Nov. 16, 2017

(30) Foreign Application Priority Data

May 10, 2016 (JP) ..... 2016-094625

(51) Int. Cl.

| | |
|---|---|
| ***G10L 19/00*** | (2013.01) |
| ***G10L 21/00*** | (2013.01) |
| ***G10L 21/0388*** | (2013.01) |
| ***G10L 19/008*** | (2013.01) |
| ***G10L 19/02*** | (2013.01) |
| ***G10L 19/12*** | (2013.01) |
| ***G10L 19/16*** | (2013.01) |
| ***G10L 19/18*** | (2013.01) |
| *G10L 21/038* | (2013.01) |

(52) U.S. Cl.

CPC ..... *G10L 21/0388* (2013.01); *G10L 19/008* (2013.01); *G10L 19/02* (2013.01); *G10L 19/12* (2013.01); *G10L 19/167* (2013.01); *G10L 19/18* (2013.01); *G10L 21/038* (2013.01); *G10L 2019/0012* (2013.01)

(58) Field of Classification Search

CPC ..... G10L 19/008; G10L 19/167; G10L 19/26; G10L 19/265; H04S 2400/01; H04S 2420/03; H04S 2400/03; G06F 3/16; H04R 2420/07; H04R 2499/11; H04R 3/04; H04R 3/12

See application file for complete search history.

(56) References Cited

U.S. PATENT DOCUMENTS 5,848,164 A * 12/1998 Levine ..... H04B 1/665 381/61
5,974,380 A * 10/1999 Smyth ..... G10L 19/0208 704/201

(Continued)

FOREIGN PATENT DOCUMENTS

JP 2008-537174 A 9/2008

*Primary Examiner* — Edgar Guerra-Erazo
(74) *Attorney, Agent, or Firm* — Brundidge & Stanger, P.C.

(57) ABSTRACT

A first encoding unit generates a first encoded signal by encoding a component within a first band in a voice signal. A frequency shifting unit shifts the frequency of a component within a second band in the voice signal, the second band having a frequency higher than that of the first band, to the frequency of a component within the first band. A second encoding unit generates a second encoded signal by encoding the component whose frequency has been shifted in the frequency shifting unit. An output unit outputs both the first encoded signal generated in the first encoding unit and the second encoded signal generated in the second encoding unit.

9 Claims, 16 Drawing Sheets

(56) References Cited

U.S. PATENT DOCUMENTS 6,925,116 B2 * 8/2005 Liljeryd ..... G10L 21/038 375/240
6,978,236 B1 * 12/2005 Liljeryd ..... G10L 19/0208 704/200
7,181,389 B2 * 2/2007 Liljeryd ..... G10L 19/0208 704/200
7,246,065 B2 * 7/2007 Tanaka ..... H04N 19/63 375/E7.092
7,283,955 B2 * 10/2007 Liljeryd ..... G10L 21/038 704/219
7,328,162 B2 * 2/2008 Liljeryd ..... G10L 21/038 704/503
7,469,206 B2 * 12/2008 Kjorling ..... G10L 19/07 704/205
7,734,473 B2 * 6/2010 Schuijers ..... G10L 21/04 704/211
2003/0187663 A1 * 10/2003 Truman ..... G10L 21/038 704/500
2005/0096917 A1 * 5/2005 Kjorling ..... G10L 19/07 704/500
2006/0031064 A1 * 2/2006 Liljeryd ..... G10L 19/0208 704/219
2006/0053018 A1 * 3/2006 Engdegard ..... G10L 19/008 704/500
2006/0165237 A1 * 7/2006 Villemoes ..... G10L 19/008 381/20
2006/0256971 A1 * 11/2006 Chong ..... G10L 19/025 381/23
2007/0016411 A1 * 1/2007 Kim ..... G10L 19/02 704/226
2007/0129036 A1 * 6/2007 Arora ..... G10L 21/038 455/205
2008/0183466 A1 * 7/2008 Nongpiur ..... G10L 19/0216 704/226
2008/0262835 A1 * 10/2008 Oshikiri ..... G10L 21/038 704/205
2009/0192804 A1 * 7/2009 Schuijers ..... G10L 19/008 704/500
2014/0200901 A1 * 7/2014 Kawashima ..... G10L 21/0388 704/500

* cited by examiner

ENCODING DEVICE, DECODING DEVICE, AND COMMUNICATION SYSTEM FOR EXTENDING VOICE BAND

CROSS-REFERENCE TO RELATED APPLICATIONS

This application is based upon and claims the benefit of priority from the prior Japanese Patent Application No. 2016-094625, filed on May 10, 2016, the entire contents of which are incorporated herein by reference.

BACKGROUND

1. Field

The present invention relates to a band extension technique, and more particularly to an encoding device, a decoding device, and a communication system for extending a voice band.

2. Description of the Related Art

In order to improve the quality of a voice signal in a communication system, a threshold frequency is defined within a passband defining the maximum frequency and minimum frequency of the voice signal on a transmission side, so that a voice signal having a frequency lower than the threshold frequency is not compressed. On the other hand, a voice signal having a frequency higher than the threshold frequency is compressed and transmitted by being compressed into the region between the threshold frequency and the maximum frequency of the passband. On a reception side, the compressed voice signal is extended and harmonic information is generated based on a non-compressed voice signal, and a suitable harmonic is added to the extended voice signal based on the harmonic information (see, for example, Patent Document 1).

RELATED ART DOCUMENT

Patent Document

[Patent Document 1] Japanese Patent Application Publication (Translation of PCT Application) No. 2008-537174

When intense compression is applied to a frequency higher than the threshold frequency while a lower frequency is left without being substantially compressed, the quality and clarity of voice may be decreased if the compressed frequency is reproduced as it is without being extended on a reception side. In order to improve the quality and clarity of voice, it is necessary to perform, on the reception side, equalization processing in accordance with a speaker or a language such that adjustment should be made each time. When voice outside a band is reproduced, it is necessary to analyze the received voice, and hence a processing load may increase due to advanced voice signal processing, a speaker output be delayed due to delay processing, or uncomfortable voice be reproduced due to the generation of an unnecessary signal.

SUMMARY

In order to solve the above problems, an encoding device according to an aspect of the present embodiment comprises: an input unit that inputs a voice signal; a first encoding unit that generates a first encoded signal by encoding a component within a first band in the voice signal input in the input unit; a frequency shifting unit that shifts the frequency of a component within a second band in the voice signal input in the input unit, the second band having a frequency higher than that of the first band, to the frequency of a component within the first band; a second encoding unit that generates a second encoded signal by encoding the component whose frequency has been shifted in the frequency shifting unit; and an output unit that outputs both the first encoded signal generated in the first encoding unit and the second encoded signal generated in the second encoding unit.

Another aspect of the present embodiment is a decoding device. The device comprises: an input unit that inputs both a first encoded signal obtained by encoding a component within a first band in a voice signal and a second encoded signal obtained by shifting the frequency of a component within a second band in the voice signal, the second band having a frequency higher than that of the first band, to the frequency of a component within the first band and by encoding the latter component; a first decoding unit that generates a first voice component within the first band by decoding the first encoded signal input in the input unit; a second decoding unit that generates a second voice component within the first band by decoding the second encoded signal input in the input unit; a frequency shifting unit that shifts the frequency of the second voice component generated in the second decoding unit to the frequency of a component within the second band; and a combination unit that combines the first voice component generated in the first decoding unit and the second voice component whose frequency has been shifted in the frequency shifting unit and outputs the combined voice component.

Still another aspect of the present embodiment is a communication system. This communication system comprises an encoding device and a decoding device. The encoding device includes: an input unit that inputs a voice signal; a first encoding unit that generates a first encoded signal by encoding a component within a first band in the voice signal input in the input unit; a frequency shifting unit that shifts the frequency of a component within a second band in the voice signal input in the input unit, the second band having a frequency higher than that of the first band, to the frequency of a component within the first band; a second encoding unit that generates a second encoded signal by encoding the component whose frequency has been shifted in the frequency shifting unit; and an output unit that outputs both the first encoded signal generated in the first encoding unit and the second encoded signal generated in the second encoding unit. The decoding device includes: an input unit that inputs both the first encoded signal and the second encoded signal from the encoding device; a first decoding unit that generates a first voice component within the first band by decoding the first encoded signal input in the input unit; a second decoding unit that generates a second voice component within the first band by decoding the second encoded signal input in the input unit; a frequency shifting unit that shifts the frequency of the second voice component generated in the second decoding unit to the frequency of a component within the second band; and a combination unit that combines the first voice component generated in the first decoding unit and the second voice component whose frequency has been shifted in the frequency shifting unit and outputs the combined voice component.

It is to be noted that any optional combination of the above constituent elements and any embodiment obtained by transforming what are expressed by the present embodiment into a method, an apparatus, a system, a recording medium, a computer program, and so on is also effective as other aspects of the present embodiment.

BRIEF DESCRIPTION OF THE DRAWINGS

Embodiments will now be described, by way of example only, with reference to the accompanying drawings, which are meant to be exemplary, not limiting, and wherein like elements are numbered alike in several figures, in which.

DETAILED DESCRIPTION

The invention will now be described by reference to the preferred embodiments. This does not intend to limit the scope of the present invention, but to exemplify the invention.

First Embodiment

Prior to the specific description of the present invention, the outline thereof will be given first. First Embodiment relates to a communication system that transmits a voice signal from a transmitter to a receiver. When the communication system is a digital wireless communication system, a vocoder method is often used for transmitting a voice signal. The vocoder method is a voice compression technology for communication. The transmitter transmits parameterized voice signals without directly transmitting waves of voice, and the receiver synthesizes the original voice from the received parameterized signals.

In such a vocoder method, a frequency component higher than the Nyquist frequency is removed. For example, "AMBE (registered trademark) +2" is used as a vocoder method in NXDN (registered trademark) that is a standard of a digital professional-use wireless system, but the sampling frequency is set to 8 kHz in AMBE +2, and hence band limitation is performed at 4 kHz. If a voice having a frequency of 4 kHz or higher is lost, voice quality and clarity may decrease. In order to improve voice quality and clarity, it is necessary to perform band extension either in equalization processing that emphasizes high frequencies in a receiver or in advanced signal processing. In addition, when a voice having a frequency of 4 kHz or higher is reproduced, it is necessary to analyze the received voice, and hence a processing load may increase due to advanced voice signal processing, a speaker output be delayed due to delay processing, or an uncomfortable voice be reproduced due to the generation of even an unnecessary signal, as described above.

In order to easily improve voice quality and clarity under such circumstances, the transmitter according to the present embodiment vocoder-encodes a component of 0 to 4 kHz in a voice signal, and vocoder-encodes a component of 4 to 8 kHz after shifting the frequency thereof to a frequency of 0 to 4 kHz. On the other hand, the receiver vocoder-decodes the latter vocoder-encoded signal and then shifts the frequency thereof to a frequency of 4 to 8 kHz, and reproduces a voice of 0 to 8 kHz by combining the result of the frequency shifting and the result of vocoder-decoding the vocoder-encoded signal of 0 to 4 kHz.

Figure 1:
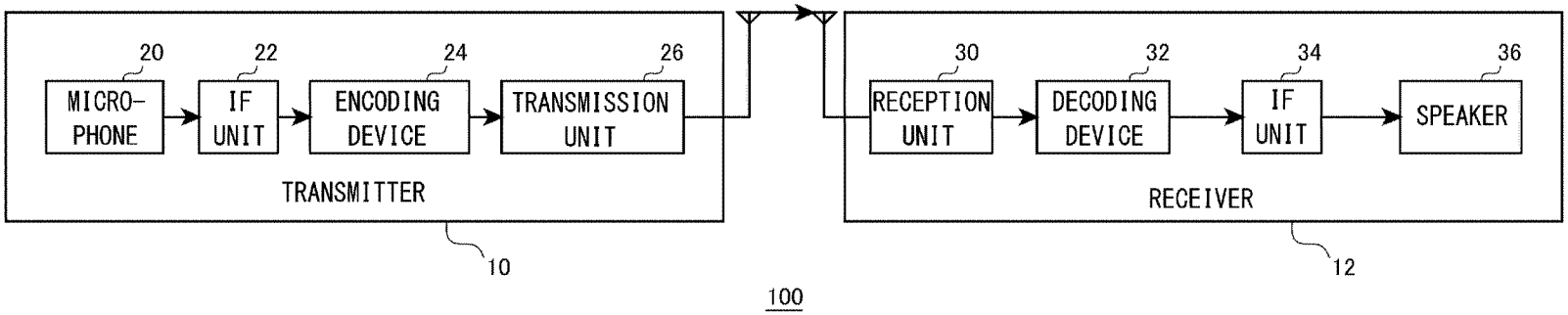
FIG. 1 is a view illustrating a configuration of a communication system according to First Embodiment.

FIG. 1 illustrates a configuration of a communication system 100 according to First Embodiment. The communication system 100 comprises a transmitter 10 and a receiver 12. The transmitter 10 includes a microphone 20, an IF unit 22, an encoding device 24, and a transmission unit 26, and the receiver 12 includes a reception unit 30, a decoding device 32, an IF unit 34, and a speaker 36. The transmitter 10 and the receiver 12 are included in a wireless device or a communication device, such as a terminal device, but herein the transmitter 10 equivalent to the transmission function of a terminal device and the receiver 12 equivalent to the reception function thereof are only illustrated in order to clarify description. Additionally, the terminal device may not be directly connected, and may be connected, for example, via a base station apparatus.

The microphone 20 inputs the voice produced by a speaker and converts this into an electric signal. The microphone 20 outputs the voice converted into an electric signal (hereinafter, referred to as a "voice signal") to the IF unit 22. The IF unit 22 inputs the voice signal from the microphone 20, and outputs the voice signal to the encoding device 24. In this case, the IF unit 22 may perform any processing on the voice signal. The encoding device 24 generates both a first encoded signal and a second encoded signal by inputting the voice signal from the IF unit 22 and vocoder-encoding the voice signal. The details of the first encoded signal and the second encoded signal will be described later. The encoding device 24 outputs the first encoded signal and the second encoded signal to the transmission unit 26. The transmission unit 26 inputs the first encoded signal and the second encoded signal from the encoding device 24, and transmits a wireless signal including these signals. The transmission unit 26 corresponds to a digital professional-use wireless system like, for example, NXDN.

The reception unit 30 receives the wireless signal from the transmission unit 26. The reception unit 30 acquires the first encoded signal and the second encoded signal from the wireless signal, and outputs them to the decoding device 32. The decoding device 32 generates a voice signal by vocoder-decoding the first encoded signal and the second encoded signal. The decoding device 32 outputs the voice signal to the IF unit 34. The IF unit 34 inputs the voice signal from the decoding device 32, and outputs it to the speaker 36. In this case, the IF unit 34 may perform processing corresponding to the processing in the IF unit 22 on the voice signal. The speaker 36 inputs the voice signal from the IF unit 34, and converts it into a voice to be output.

Figure 2:
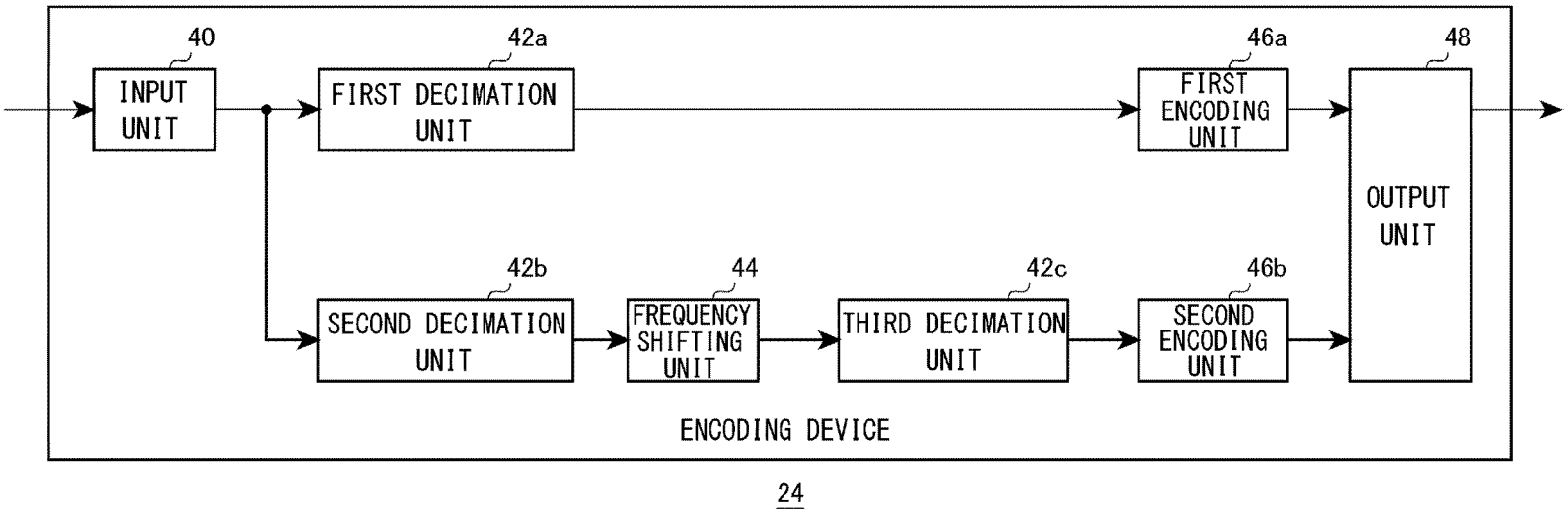
FIG. 2 is a view illustrating a configuration of an encoding device in FIG. 1.

FIG. 2 illustrates a configuration of the encoding device 24. The encoding device 24 includes: an input unit 40; a first decimation unit 42*a*, a second decimation unit 42*b*, and a third decimation unit 42*c*, which are collectively referred to as a decimation unit 42; a frequency shifting unit 44; a first encoding unit 46*a* and a second encoding unit 46*b* that are collectively referred to as an encoding unit 46; and an output unit 48.

The input unit 40 inputs the voice signal from the non-illustrated IF unit 22. The sampling frequency for the input voice signal is, for example, 48 kHz. The input unit 40 outputs the voice signal to the first decimation unit 42*a* and the second decimation unit 42*b*.

The first decimation unit 42*a* inputs the voice signal from the input unit 40. The first decimation unit 42*a* downsamples the sampling frequency for the voice signal from 48 kHz to 8 kHz. The downsampled voice signal contains a voice component within a band of 0 to 4 kHz. Herein, the band of 0 to 4 kHz is also referred to as a first band, and hence the voice component within the band of 0 to 4 kHz can also be referred to as a component within the first band. The first decimation unit 42*a* outputs the downsampled voice signal (hereinafter, this is also referred to as the "voice signal"), i.e., the component within the first band to the first encoding unit 46*a*.

The first encoding unit 46*a* inputs the voice signal from the first decimation unit 42, i.e., the component within the first band. The first encoding unit 46*a* vocoder-encodes the component within the first band. In this case, the sampling frequency of the vocoder processing is 8 kHz. The first encoding unit 46*a* outputs the vocoder-encoded component within the first band (hereinafter, referred to as the "first encoded signal") to the output unit 48.

The second decimation unit 42*b* inputs the voice signal from the input unit 40. The second decimation unit 42*b* downsamples the sampling frequency for the voice signal from 48 kHz to 16 kHz. Herein, the sampling frequency is downsampled up to 16 kHz in order to handle a voice component outside a band of 8 kHz. The second decimation unit 42*b* outputs the downsampled voice signal (hereinafter, this is also referred to as the "voice signal") to the frequency shifting unit 44.

The frequency shifting unit 44 inputs the voice signal from the second decimation unit 42*b*. The frequency shifting unit 44 shifts the frequency of a voice component of 4 to 8 kHz contained in the voice signal to the frequency of a component of 0 to 4 kHz. This is equivalent to the fact that the frequency of a voice component of 4 to 8 kHz, outside the band, is shifted to the frequency of a component within the band of 0 to 4 kHz. Herein, the band of 4 to 8 kHz is also referred to as a second band, and hence it can also be said that the frequency shifting unit 44 shifts the frequency of a component within the second band in the voice signal, the second band having a frequency higher than that of the first band, to the frequency of a component within the first band. This is because: the bandwidth that can be processed in the later-described second encoding unit 46*b* is set up to 4 kHz, and hence a component of a high frequency outside the band is to be processed in the second encoding unit 46*b* by shifting the frequency of the component. Herein, the bandwidth of the second band is the same as that of the first band. The frequency shifting unit 44 outputs the voice signal whose frequency has been shifted (hereinafter, this is also referred to as the "voice signal"), i.e., the component within the second band whose frequency has been shifted to that of a component within the first band (hereinafter, this is also referred to as the "component within the second band") to the third decimation unit 42*c*.

The third decimation unit 42*c* inputs the voice signal from the frequency shifting unit 44. The third decimation unit 42*c* downsamples the sampling frequency for the voice signal from 16 kHz to 8 kHz. The third decimation unit 42*c* outputs the downsampled voice signal (hereinafter, this is also referred to as the "voice signal") to the second encoding unit 46*b*. Herein, the output voice signal also contains the component within the second band.

The second encoding unit 46*b* inputs the voice signal from the third decimation unit 42*c*, i.e., the component within the second band. The second encoding unit 46*b* vocoder-encodes the component within the second band. In this case, the sampling frequency of the vocoder processing is 8 kHz. The second encoding unit 46*b* outputs the vocoder-encoded component within the second band (hereinafter, referred to as the "second encoded signal") to the output unit 48.

The output unit 48 inputs both the first encoded signal from the first encoding unit 46*a* and the second encoded signal from the second encoding unit 46*b*, and outputs these signals. In particular, the output unit 48 outputs the first encoded signal and the second encoded signal while switching the output order in accordance with the order in which the non-illustrated transmission unit 26 transmits signals, i.e., the order determined by the frames of a wireless communication channel.

Figure 3:
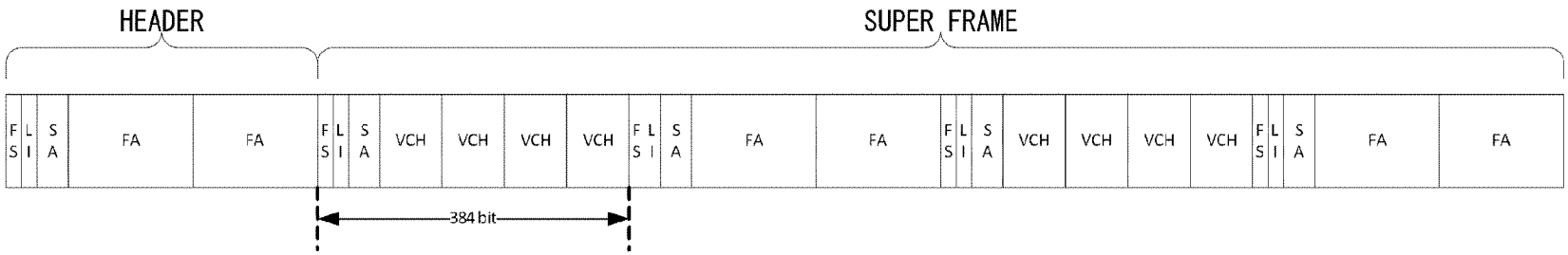
FIG. 3 is a view illustrating a signal format to be used in another communication system compared with the communication system of FIG. 1.

Herein, prior to the description of this, a frame format in a wireless communication channel (RTCH) used during voice communication in an NXDN 9600 bps (Half Rate) system will be described, as a comparison object, by referring to FIG. 3. FIG. 3 illustrates a signal format to be used in another communication system to be compared with the communication system 100. Herein, "FS" indicates a frame sync word, "LI" a link information channel, "SA" a low-speed accompanying control channel, "VCH" a voice channel, and "FA" a high-speed accompanying control channel 1 (FACCH1). In this case, the first encoded signal is stored in VCH. On the other hand, the second encoded signal is not stored, so that it is not transmitted. Refer back to FIG. 2.

Figure 4:
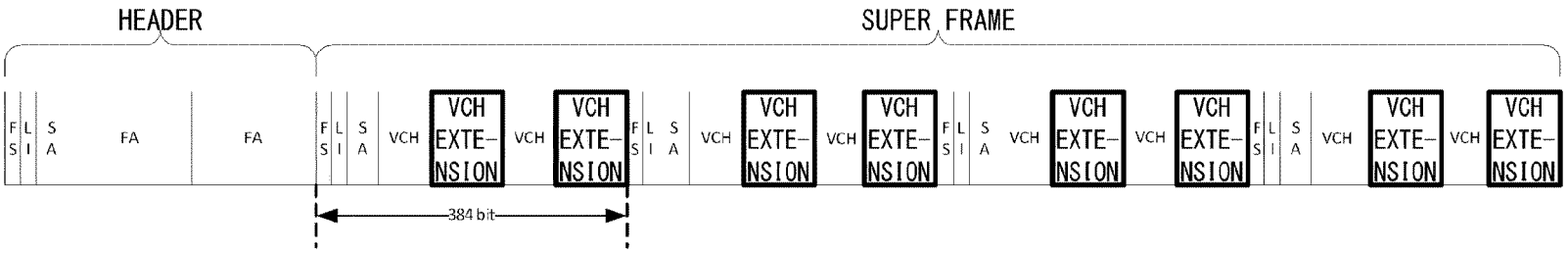
FIG. 4 is a view illustrating a signal format to be used in the communication system of FIG. 1.

Next, two types of formats for storing the second encoded signal will be described, and either of them may be used. In order to cause to correspond to the first format, the output unit 48 alternately outputs the first encoded signal and the second encoded signal. FIG. 4 illustrates a signal format to be used in the communication system 100. Herein, "VCH (extension)", indicating an extended voice channel, stores the second encoded signal. In FIG. 4, "VCH" and "VCH (extension)" are arranged in a region where "VCH" and "FA" are arranged in FIG. 3. That is, "FA" is not included in FIG. 4. After a telephone call is started, "FA" generally contains only a control code such as, for example, idle information or a message indicating that voice communication is being performed, and hence the telephone call is not affected if such a control code is not transmitted. Therefore, "VCH (extension)" is transmitted instead of transmitting "FA." In particular, VCH and VCH (extension) are alternately arranged.

In this case, VCH, VCH (extension), VCH, and VCH (extension) are arranged in this order, and hence a combination of the continuous VCH and VCH (extension) becomes a single voice signal. Therefore, the receiver 12 continuously acquires voice components outside the band by vocoder-decoding VCH to acquire voice components within the band and then by vocoder-decoding VCH (extension). Further, the receiver 12 reproduces a voice by combining the result of vocoder-decoding VCH and that of vocoder-decoding VCH (extension), and hence the adjustment of the order of the results of vocoder-decoding becomes unnecessary, whereby processing becomes simple.

Figure 5:
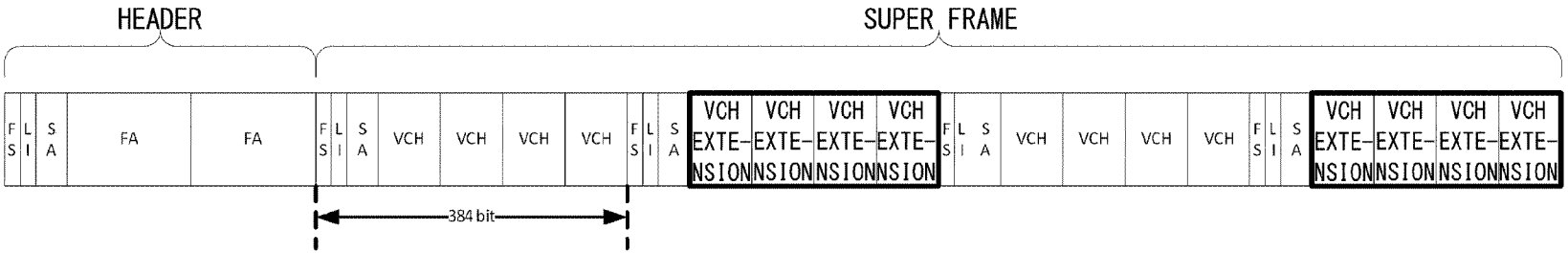
FIG. 5 is a view illustrating another signal format to be used in the communication system of FIG. 1.

In order to cause to correspond to the second format, the output unit 48 continuously outputs a plurality of the first encoded signals, and then continuously outputs a plurality of the second encoded signals. FIG. 5 illustrates another signal format to be used in the communication system 100. In FIG. 5, "VCH (extension)" is arranged as it is in the region where "FA" is arranged in FIG. 3. In this case, even if a receiver only corresponding to the format of FIG. 3 receives the signal of the frame format of FIG. 5, it is only necessary to discard VCH (extension), and hence vocoder-decoding of VCH is executed. That is, communication is not affected and compatibility is maintained.

This configuration is implemented in the hardware by any CPU of a computer, memory, and other LSI, and implemented in the software by a program or the like that is loaded in a memory. Herein, functional blocks implemented by the cooperation of hardware and software are depicted. Thus, it is to be understood by a person skilled in the art that these functional blocks can be implemented in various forms, namely, solely in hardware, solely in software, or through a combination of hardware and software.

Figure 6:
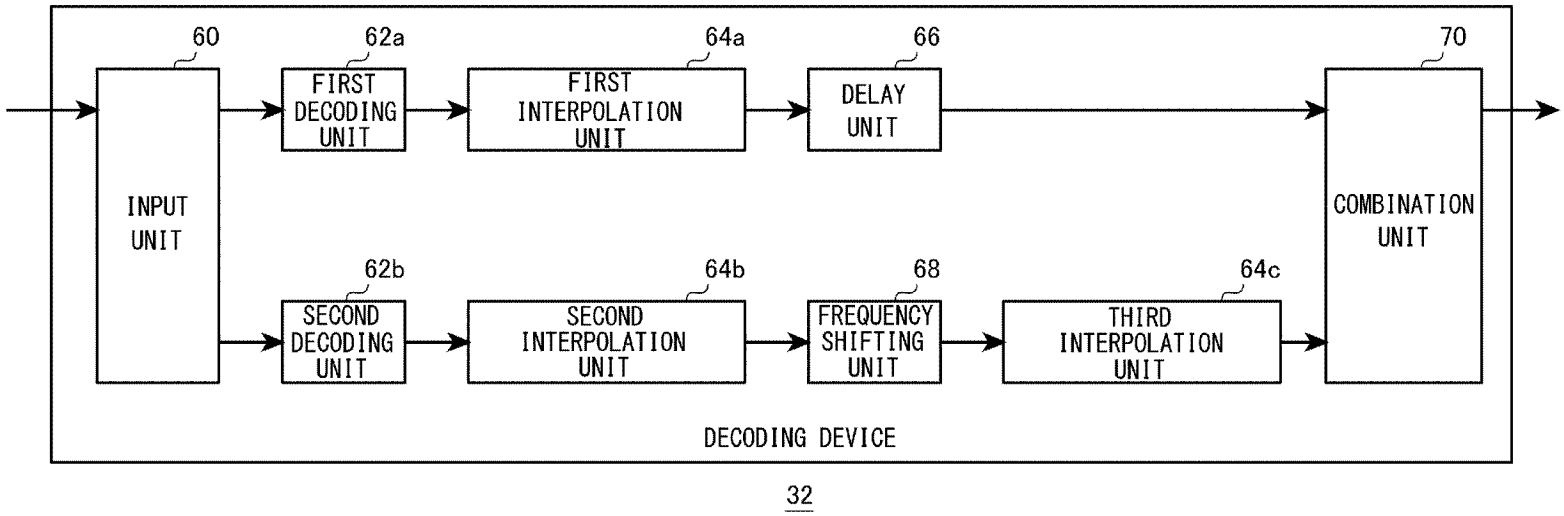
FIG. 6 is a view illustrating a configuration of a decoding device in FIG. 1.

FIG. 6 illustrates a configuration of the decoding device 32. The decoding device 32 includes: an input unit 60; a first decoding unit 62*a* and a second decoding unit 62*b* that are collectively referred to as a decoding unit 62; a first interpolation unit 64*a*, a second interpolation unit 64*b*, and a third interpolation unit 64*c*, which are collectively referred to as an interpolation unit 64; a delay unit 66; a frequency shifting unit 68; and a combination unit 70.

The input unit 60 inputs the first encoded signal and the second encoded signal from the non-illustrated reception unit 30. When the format of the signal received in the reception unit 30 corresponds to FIG. 4, the input unit 60 alternately inputs the first encoded signal and the second encoded signal. On the other hand, when the format of the signal received in the reception unit 30 corresponds to FIG. 5, the input unit 60 continuously inputs a plurality of the first encoded signals, and then continuously inputs a plurality of the second encoded signals. The sampling frequency for each of the first encoded signal and the second encoded signal that have been input is, for example, 8 kHz. The input unit 60 outputs the first encoded signal to the first decoding unit 62*a* and the second encoded signal to the second decoding unit 62*b*.

The first decoding unit 62*a* inputs the first encoded signal from the input unit 60. The first decoding unit 62*a* vocoder-decodes the first encoded signal. In this case, the sampling frequency of the vocoder processing is 8 kHz. The first decoding unit 62*a* outputs the vocoder-decoded first encoded signal (hereinafter, referred to as a "first voice component") to the first interpolation unit 64*a*. The first voice component is a voice component within a band of 0 to 4 kHz, and is a voice component within the first band. Because the first voice component is contained in a voice signal having a sampling frequency of 8 kHz, it can also be said that the voice signal is output to the first interpolation unit 64*a*.

The first interpolation unit 64*a* inputs the voice signal from the first decoding unit 62*a*, i.e., the first voice component. The first interpolation unit 64*a* upsamples the sampling frequency for the voice signal from 8 kHz to 48 kHz. The upsampled voice signal also contains the first voice component within the first band. The first interpolation unit 64*a* outputs the upsampled voice signal (hereinafter, this is also referred to as the "voice signal"), i.e., the first voice component to the delay unit 66.

The delay unit 66 inputs the voice signal from the first interpolation unit 64*a*, i.e., the first voice component. The delay unit 66 delays the voice signal only by a period in accordance with the format illustrated in FIG. 4 or FIG. 5. The delay unit 66 outputs the delayed voice signal (hereinafter, this is also referred to as the "voice signal"), i.e., the first voice component to the combination unit 70.

The second decoding unit 62*a* inputs the second encoded signal from the input unit 60. The second decoding unit 62*b* vocoder-decodes the second encoded signal. In this case, the sampling frequency of the vocoder processing is 8 kHz. The second decoding unit 62*a* outputs the vocoder-decoded second encoded signal (hereinafter, referred to as a "second voice component") to the second interpolation unit 64*b*. The second voice component is a voice component outside the band of 4 to 8 kHz, and is a voice component within the second band. Herein, the frequency of the second voice component is shifted to that of a component within the band of 0 to 4 kHz, i.e., within the first band. Also, the second voice component is contained in a voice signal having a sampling frequency of 8 kHz, and hence it can also be said that the voice signal is output to the second interpolation unit 64*b*.

The second interpolation unit 64*a* inputs the voice signal from the second decoding unit 62*b*, i.e., the second voice component. The second interpolation unit 64*b* upsamples the sampling frequency for the voice signal from 8 kHz to 16 kHz. The upsampled voice signal also contains the second voice component within the first band. The second interpolation unit 64*b* outputs the upsampled voice signal (hereinafter, this is also referred to as the "voice signal"), i.e., the second voice component to the frequency shifting unit 68.

The frequency shifting unit 68 inputs the voice signal from the second interpolation unit 64*b*, i.e., the second voice component. The frequency shifting unit 68 shifts the frequency of the voice component of 0 to 4 kHz contained in the voice signal to that of a component of 4 to 8 kHz. This is equivalent to the fact that a voice component outside the band of 0 to 4 kHz, the frequency of which has been shifted to that of a component within the band thereof, is returned to a voice component within the band of 4 to 8 kHz. Therefore, it is equivalent to the fact that the frequency of the second voice component within the first band is shifted to that of a component within the second band. The frequency shifting unit 68 outputs the voice signal whose frequency has been shifted (hereinafter, this is also referred to as the "voice signal"), i.e., the second voice component whose frequency has been shifted to a component within the second band (hereinafter, this is also referred to as the "second voice component") to the third interpolation unit 64*c*.

The third interpolation unit 64*c* inputs the voice signal from the frequency shifting unit 68, i.e., the second voice component. The third interpolation unit 64*c* upsamples the sampling frequency for the voice signal from 16 kHz to 48 kHz. The upsampled voice signal also contains the second voice component within the second band. The third interpolation unit 64*c* outputs the upsampled voice signal (hereinafter, this is also referred to as the "voice signal"), i.e., the second voice component to the combination unit 70.

The combination unit 70 inputs the voice signal from the delay unit 66, i.e., the first voice component, and inputs the voice signal from the third interpolation unit 64*c*, i.e., the second voice component. The combination unit 70 combines the first voice component and the second voice component with addition processing. The voice component obtained by combining the first voice component and the second voice component is contained in the voice signal. The combination unit 70 outputs the voice signal to the non-illustrated IF unit 34.

Figure 7:
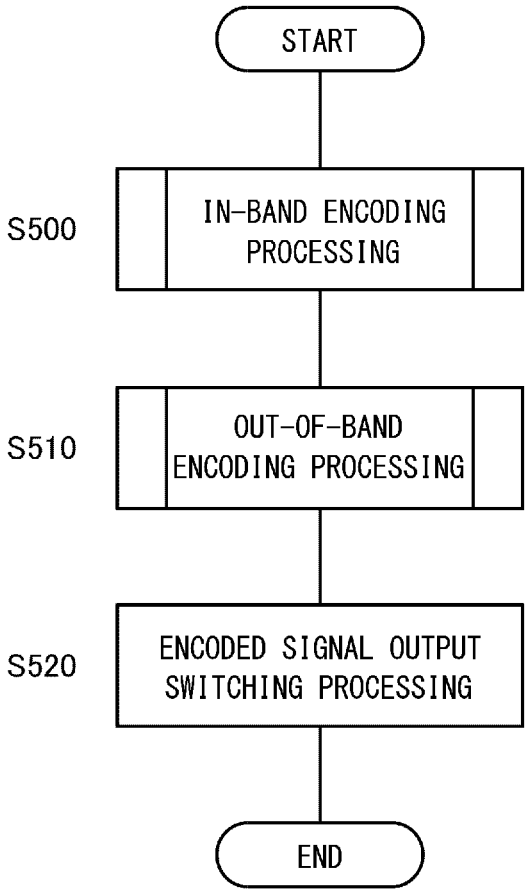
FIG. 7 is a flowchart illustrating an output procedure by the encoding device of FIG. 2.

An operation of the communication system 100 configured as described above will be described. FIG. 7 is a flowchart illustrating an output procedure by the encoding device 24. The first decimation unit 42*a* and the first encoding unit 46*a* execute in-band encoding processing (S500). The second decimation unit 42*b*, the frequency shifting unit 44, the third decimation unit 42*c*, and the second encoding unit 46*b* execute out-of-band encoding processing (S510). The output unit 48 executes output switching processing on an encoded signal (S520).

Figure 8:
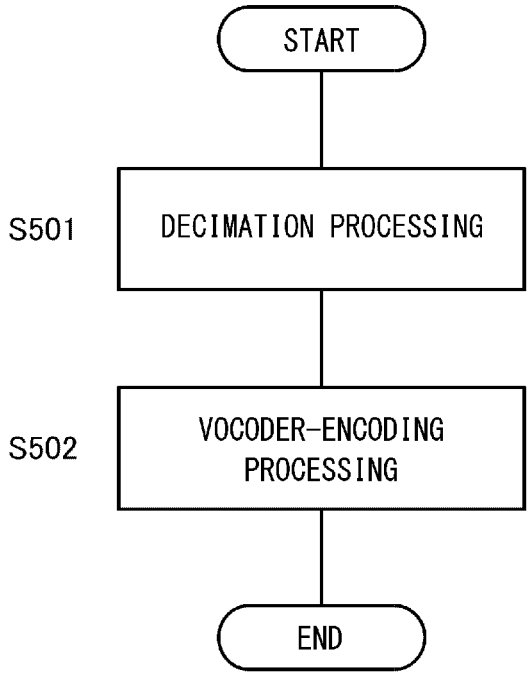
FIG. 8 is a flowchart illustrating a procedure of in-band encoding processing in FIG. 7.

FIG. 8 is a flowchart illustrating a procedure of the in-band encoding processing. The first decimation unit 42*a* executes decimation processing (S501). The first encoding unit 46*a* executes vocoder-encoding processing (S502).

Figure 9:
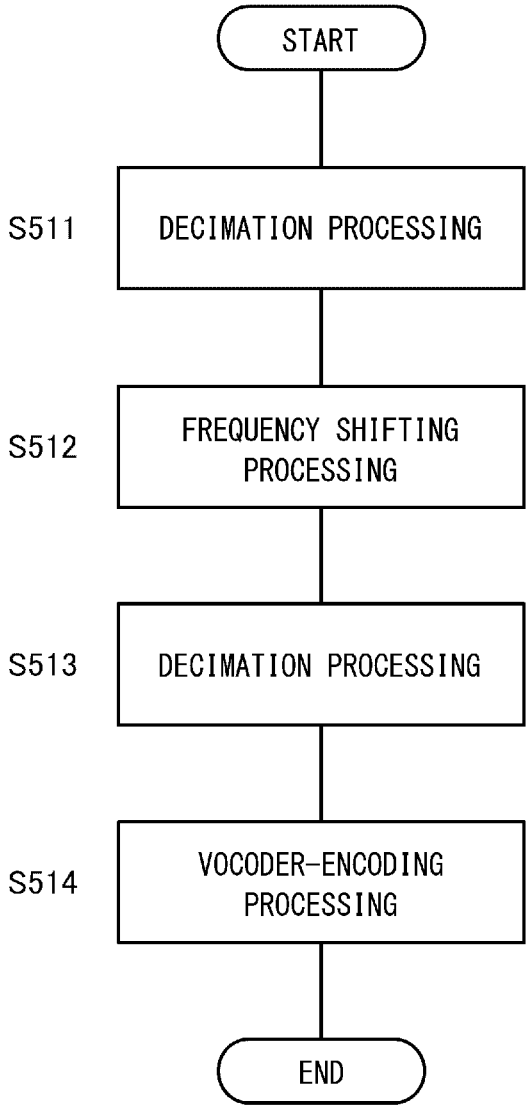
FIG. 9 is a flowchart illustrating a procedure of out-of-band encoding processing in FIG. 7.

FIG. 9 is a flowchart illustrating a procedure of the out-of-band encoding processing. The second decimation unit 42*b* executes decimation processing (S511). The frequency shifting unit 44 executes frequency shifting processing (S512). The third decimation unit 42*c* executes decimation processing (S513). The second encoding unit 46*b* executes vocoder-encoding processing (S514).

Figure 10:
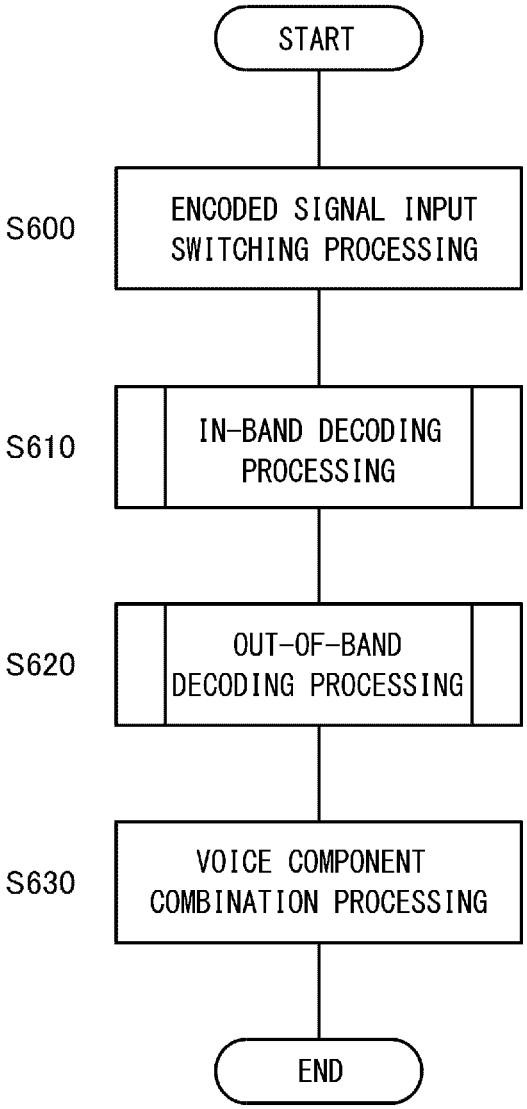
FIG. 10 is a flowchart illustrating a combination procedure by the decoding device of FIG. 6.

FIG. 10 is a flowchart illustrating a combination procedure by the decoding device 32. The input unit 60 executes input switching processing on an encoded signal (S600). The first decoding unit 62*a*, the first interpolation unit 64*a*, and the delay unit 66 execute in-band decoding processing (S610). The second decoding unit 62*b*, the second interpolation unit 64*b*, the frequency shifting unit 68, and the third interpolation unit 64*c* execute out-of-band decoding processing (S620). The combination unit 70 executes combination processing on voice components (S630).

Figure 11:
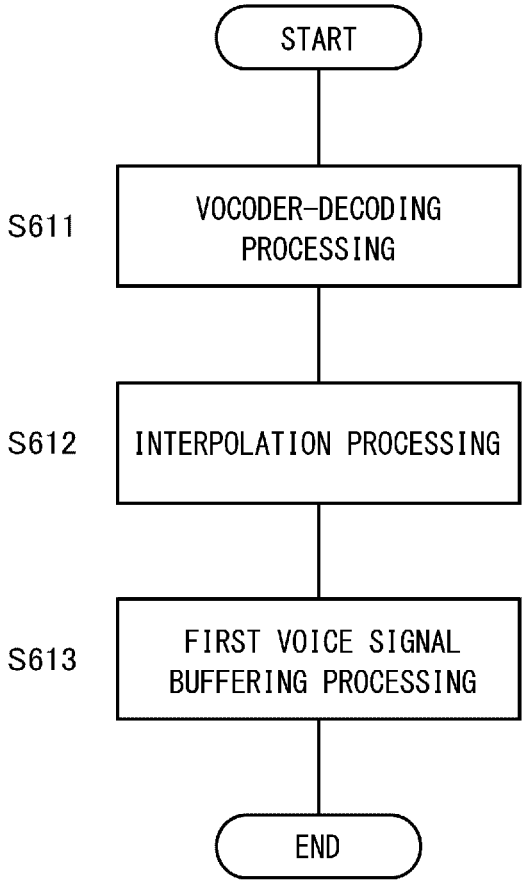
FIG. 11 is a flowchart illustrating a procedure of in-band decoding processing in FIG. 10.

FIG. 11 is a flowchart illustrating a procedure of the in-band decoding processing. The first decoding unit 62*a* executes vocoder-decoding processing (S611). The first interpolation unit 64*a* executes interpolation processing (S612). The delay unit 66 executes buffering processing (S613).

Figure 12:
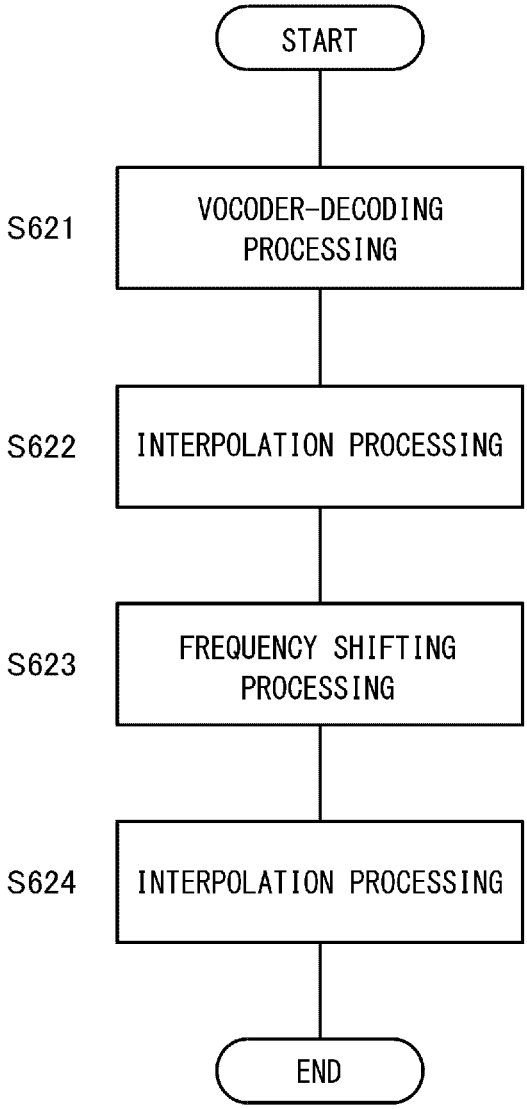
FIG. 12 is a flowchart illustrating a procedure of out-of-band decoding processing in FIG. 10.

FIG. 12 is a flowchart illustrating a procedure of the out-of-band decoding processing. The second decoding unit 62*b* executes vocoder-decoding processing (S621). The second interpolation unit 64*b* executes interpolation processing (S622). The frequency shifting unit 68 executes frequency shifting processing (S623). The third interpolation unit 64*c* executes interpolation processing (S624).

Hereinafter, a configuration for further improving voice quality and clarity in each of the encoding device 24 and the decoding device 32 described above will be described. The encoding device 24 and the decoding device 32 described above do not include an equalizer for reasons such as suppression of an increase in a processing load and the like. On the other hand, at least one of the encoding device 24 and the decoding device 32 includes an equalizer herein.

Figure 13:
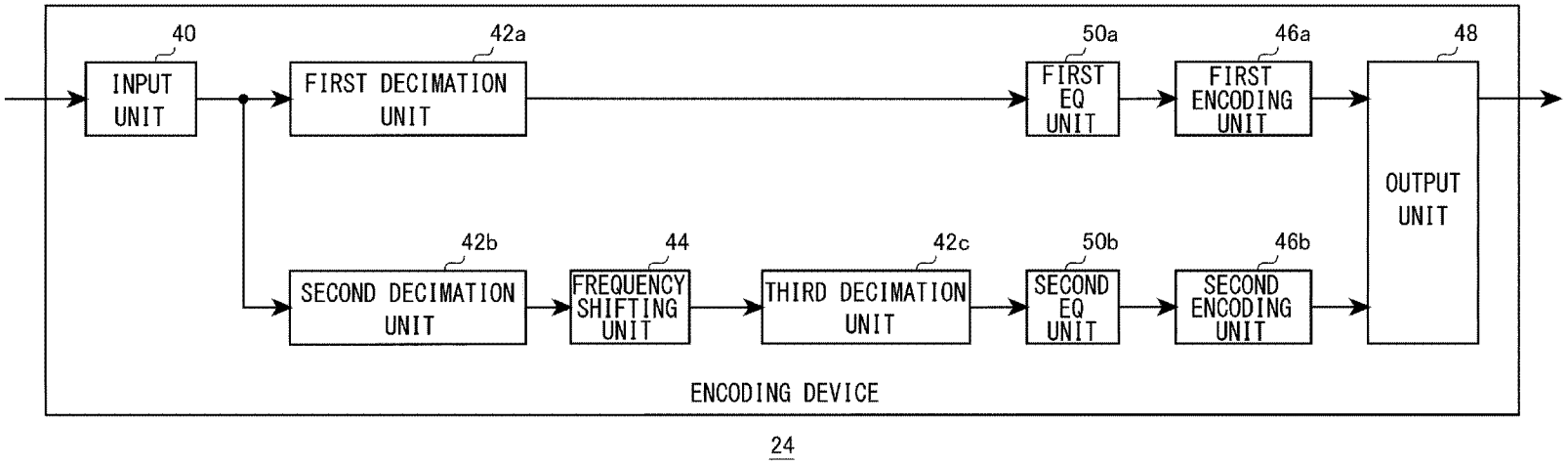
FIG. 13 is a view illustrating another configuration of the encoding device in FIG. 1.

FIG. 13 illustrates another configuration of the encoding device 24. In the encoding device 24, a first EQ unit 50*a* and a second EQ unit 50*b* that are collectively referred to as an EQ unit 50 are added to the encoding device 24 illustrated in FIG. 2. The first EQ unit 50*a* is arranged between the first decimation unit 42*a* and the first encoding unit 46*a*, and the second EQ unit 50*b* between the third decimation unit 42*c* and the second encoding unit 46*b*.

The first EQ unit 50*a* inputs the voice signal from the first decimation unit 42*a*, i.e., the component within the first band. The first EQ unit 50*a* executes equalization processing on the component within the first band. In the equalization processing, voice quality to a vowel is improved with a formant corresponding to the vowel being further emphasized. The equalization processing may be implemented by any publicly known technique, and thus description thereof will be omitted herein. The first EQ unit 50*a* outputs the equalization-processed component within the first band (hereinafter, this is also referred to as the "component within the first band"), i.e., the voice signal to the first encoding unit 46*a*.

The second EQ unit 50*b* inputs the voice signal from the third decimation unit 42*c*, i.e., the component within the second band. The second EQ unit 50*b* executes equalization processing on the component within the second band. In the equalization processing, voice quality to a consonant is improved with a formant corresponding to the consonant being further emphasized. The equalization processing may be implemented by any publicly known technique, and thus description thereof will be omitted herein. The second EQ unit 50*b* outputs the equalization-processed component within the second band (hereinafter, this is also referred to as the "component within the second band"), i.e., the voice signal to the second encoding unit 46*b*.

Figure 14:
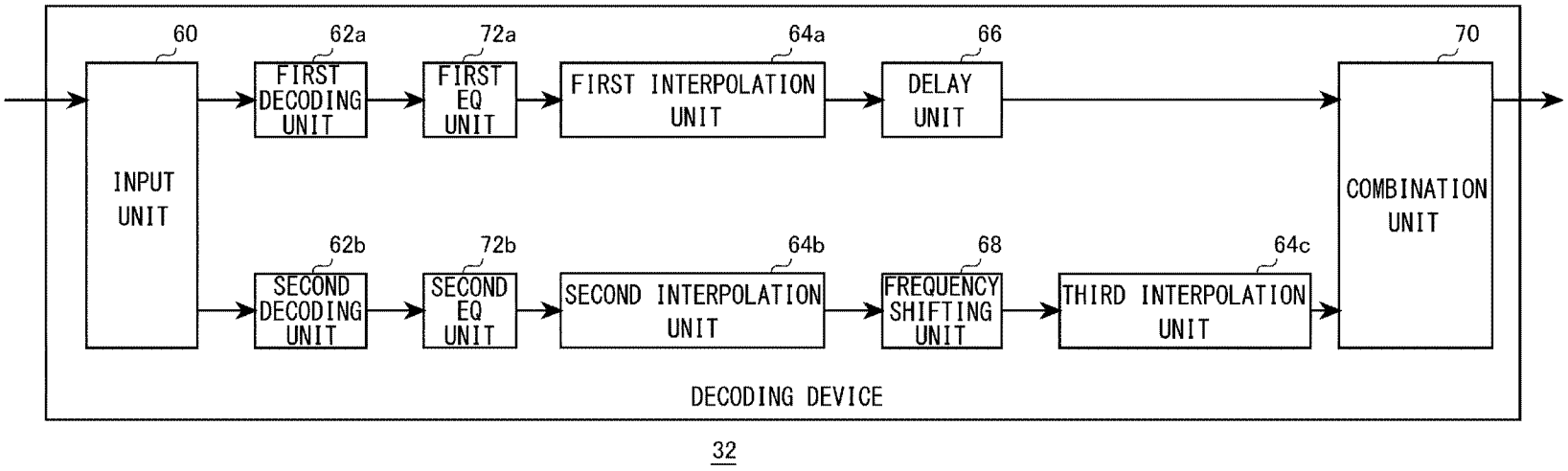
FIG. 14 is a view illustrating another configuration of the decoding device in FIG. 1.

FIG. 14 illustrates another configuration of the decoding device 32. In the decoding device 32, a first EQ unit 72*a* and a second EQ unit 72*b* that are collectively referred to as an EQ unit 72 are added to the decoding device 32 illustrated in FIG. 6. The first EQ unit 72*a* is arranged between the first decoding unit 62*a* and the first interpolation unit 64*a*, and the second EQ unit 72*b* between the second decoding unit 62*b* and the second interpolation unit 64*b*. The first EQ unit 72*a* executes the same processing as the first EQ unit 50*a* and the second EQ unit 72*b* executes the same processing as the second EQ unit 50*b*, and thus description thereof will be omitted herein.

In such a configuration, the encoding device 24 of FIG. 2 may be included in the transmitter 10, and the decoding device 32 of FIG. 14 in the receiver 12. Alternatively, the encoding device 24 of FIG. 13 may be included in the transmitter 10, and the decoding device 32 of FIG. 6 in the receiver 12. Further, the encoding device 24 of FIG. 13 may be included in the transmitter 10, and the decoding device 32 of FIG. 14 in the receiver 12.

According to the present embodiment, the first encoded signal is generated from the component within the first band and the second encoded signal from the component within the second band, and hence a component outside the band can also be encoded. Further, a component outside the band is encoded, and hence voice quality and clarity can be improved. Furthermore, a component within the second band is encoded after the frequency thereof is shifted to that of a component within the first band, and hence a second encoding unit corresponding to the first band can be used. Still furthermore, the first encoded signal is generated from a component within the first band and the second encoded signal from a component within the second band, and hence a voice of 0 to 8 kHz can be reproduced without performing advanced voice signal processing. Still furthermore, the second encoded signal is generated based on a component of 4 to 8 kHz, the unnaturalness of the voice reproduced on the reception side can be reduced. Still furthermore, the first encoded signal and the second encoded signal are alternately output, and hence processing delay can be reduced.

Still furthermore, a plurality of the first encoded signals are continuously output and then a plurality of the second encoded signals are continuously output, and hence changing of the positions of VCH where the first encoded signals are to be stored can be made unnecessary. Still furthermore, changing of the positions of VCH where the first encoded signals are to be stored is made unnecessary, and hence the first encoded signal can be decoded also in a receiver that does not correspond to the decoding of the second encoded signal. Still furthermore, the first encoded signal is decoded also in a receiver that does not correspond to the decoding of the second encoded signal, and hence compatibility can be maintained. Still furthermore, equalization processing is executed in an encoding device, voice quality and clarity can be further improved. Still furthermore, equalization processing is executed in a decoding device, voice quality and clarity can be further improved.

Second Embodiment

Second Embodiment will now be described. Second Embodiment relates to a communication system that transmits a voice signal from a transmitter to a receiver, similarly to First Embodiment. Until now, the NXDN 9600 bps (Half Rate) system has been described as an example of the communication system 100. Therefore, a voice signal with a bandwidth of 8 kHz is divided into a component of 0 to 4 kHz and that of 4 to 8 kHz. In Second Embodiment, a voice signal is equally divided into n components. A communication system 100 according to Second Embodiment is of a type similar to FIG. 1. Herein, description will be made centering on the points different from First Embodiment.

Figure 15:
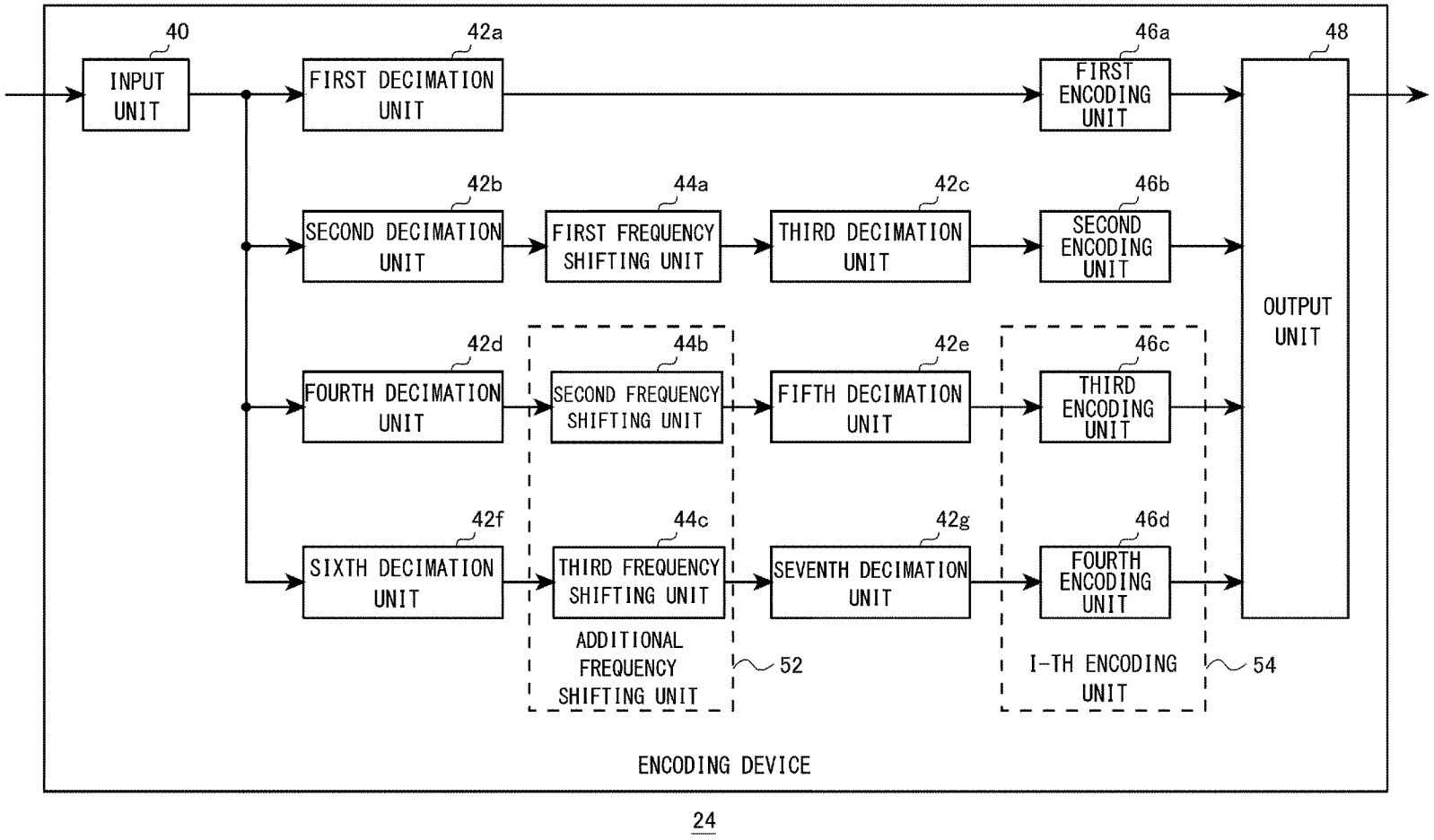
FIG. 15 is a view illustrating a configuration of an encoding device according to Second Embodiment.

FIG. 15 illustrates a configuration of an encoding device 24 according to Second Embodiment. The encoding device 24 includes: an input unit 40; a first decimation unit 42*a*, a second decimation unit 42*b*, a third decimation unit 42*c*, a fourth decimation unit 42*d*, a fifth decimation unit 42*e*, a sixth decimation unit 42*f*, and a seventh decimation unit 42*g*, which are collectively referred to as a decimation unit 42; a first frequency shifting unit 44*a*, a second frequency shifting unit 44*b*, and a third frequency shifting unit 44*c*, which are collectively referred to as a frequency shifting unit 44; a first encoding unit 46*a*, a second encoding unit 46*b*, a third encoding unit 46*c*, and a fourth encoding unit 46*d*, which are collectively referred to as an encoding unit 46; and an output unit 48. The first frequency shifting unit 44*a* corresponds to the aforementioned frequency shifting unit 44. Herein, the second frequency shifting unit 44*b* and the third frequency shifting unit 44*c* are grouped into an additional frequency shifting unit 52, and the third encoding unit 46*c* and the fourth encoding unit 46*d* are grouped into an i-th encoding unit 54.

The first decimation unit 42*a* and the first encoding unit 46*a* generate a first encoded signal by vocoder-encoding a component within a first band in a voice signal. The second decimation unit 42*b*, the first frequency shifting unit 44*a*, the third decimation unit 42*c*, and the second encoding unit 46*b* generate a second encoded signal by shifting the frequency of a component within a second band in the voice signal to that of a component within the first band and then by vocoder-encoding the component. These are the same processing as in First Embodiment. On the other hand, the fourth decimation unit 42*d*, the second frequency shifting unit 44*b*, the fifth decimation unit 42*e*, and the third encoding unit 46*c* generate a third encoded signal by shifting the frequency of a component within a third band in the voice signal to that of a component within the first band and then by vocoder-encoding the component. The sixth decimation unit 42*f*, the third frequency shifting unit 44*c*, the seventh decimation unit 42*g*, and the fourth encoding unit 46*d* generate a fourth encoded signal by shifting the frequency of a component within a fourth band in the voice signal to that of a component within the first band and then by vocoder-encoding the component.

That is, the additional frequency shifting unit 52 shifts the frequency of a component within an i-th (i>2) band in a voice signal, the i-th band having a frequency higher than that of the (i−1)-th band, to that of a component within the first band. The i-th encoding unit 54 generates an i-th encoded signal by vocoder-encoding the component whose frequency has been shifted in the frequency shifting unit 44. The bandwidths of the first band to the fourth band are the same as each other, and they may not be 4 kHz as in First Embodiment. Also, the voice signal is equally divided into "4" components, but the number of equal divisions is not limited to "4." Also, the sampling frequency in the decimation unit 42 and the like may be appropriately set. Finally, the output unit 48 also outputs the i-th encoded signal generated in the i-th encoding unit 54.

Figure 16:
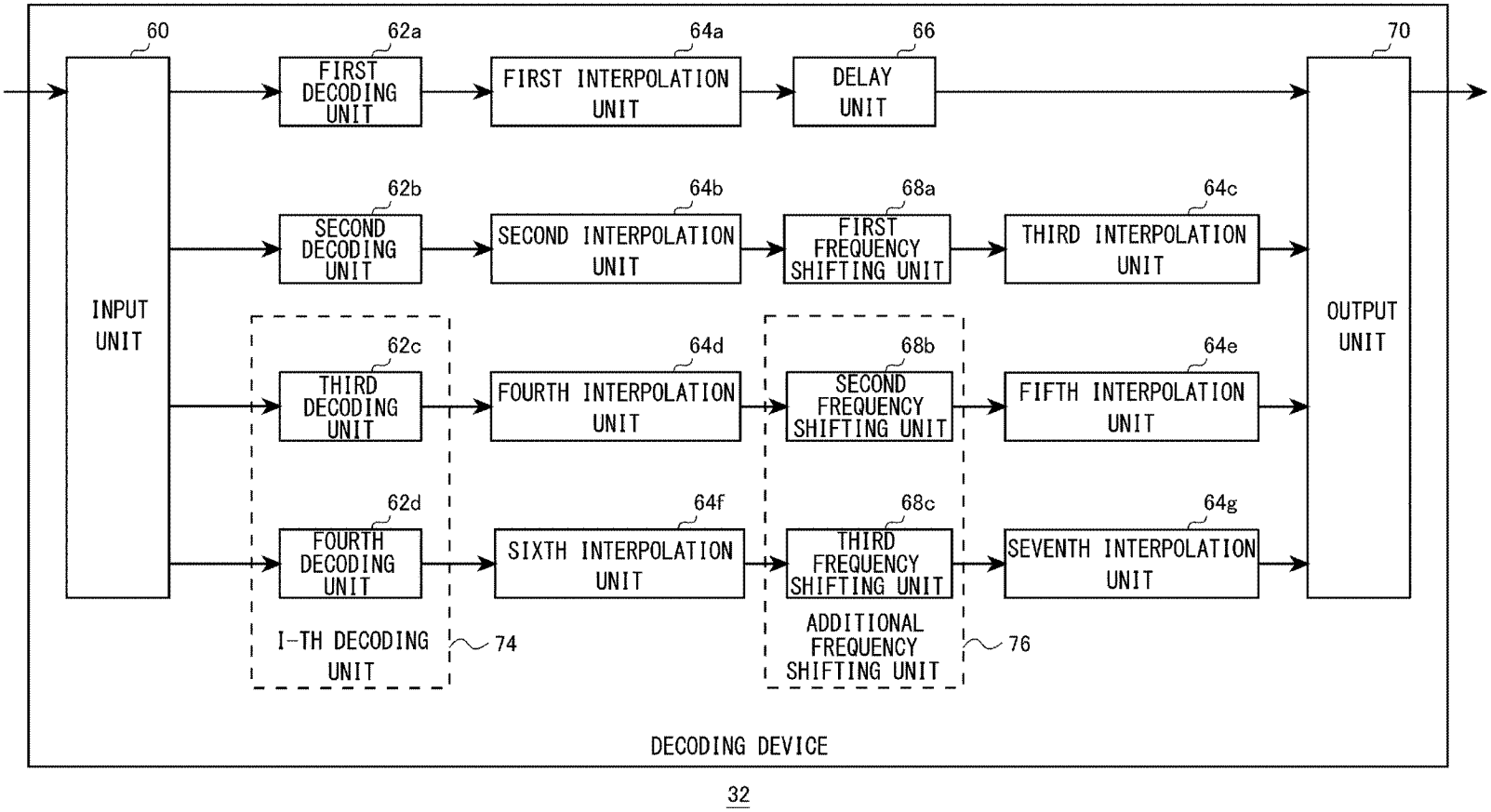
FIG. 16 is a view illustrating a configuration of a decoding device according to Second Embodiment.

FIG. 16 illustrates a configuration of a decoding device 32 according to Second Embodiment. The decoding device 32 includes: an input unit 60; a first decoding unit 62*a*, a second decoding unit 62*b*, a third decoding unit 62*c*, and a fourth decoding unit 62*d*, which are collectively referred to as a decoding unit 62; a first interpolation unit 64*a*, a second interpolation unit 64*b*, a third interpolation unit 64*c*, a fourth interpolation unit 64*d*, a fifth interpolation unit 64*e*, a sixth interpolation unit 64*f*, and a seventh interpolation unit 64*g*, which are collectively referred to as an interpolation unit 64; a delay unit 66; a first frequency shifting unit 68*a*, a second frequency shifting unit 68*b*, and a third frequency shifting unit 68*c*, which are collectively referred to as a frequency shifting unit 68; and a combination unit 70. The first frequency shifting unit 68*a* corresponds to the aforementioned frequency shifting unit 68. Herein, the third decoding unit 62*c* and the fourth decoding unit 62*d* are grouped into an i-th decoding unit 74, and the second frequency shifting unit 68*b* and the third frequency shifting unit 68*c* are grouped into an additional frequency shifting unit 76.

The first decoding unit 62*a* and the first interpolation unit 64*a* generate a first voice component by decoding the first encoded signal. The second decoding unit 62*b*, the second interpolation unit 64*b*, the first frequency shifting unit 68*a*, and the third interpolation unit 64*c* generate a second voice component obtained by decoding the second encoded signal, and then shift the frequency thereof to that of a component within the second band. These are the same processing as in First Embodiment. On the other hand, the third decoding unit 62*c*, the fourth interpolation unit 64*d*, the second frequency shifting unit 68*b*, and the fifth interpolation unit 64*e* generate a third voice component obtained by decoding the third encoded signal, and then shift the frequency thereof to that of a component within the third band. The fourth decoding unit 62*d*, the sixth interpolation unit 64*f*, the third frequency shifting unit 68*c*, and the seventh interpolation unit 64*g* generate a fourth voice component obtained by decoding the fourth encoded signal, and then shift the frequency thereof to that of a component within the fourth band.

That is, the i-th decoding unit 74 generates an i-th voice component within the first band by decoding the i-th encoded signal. The additional frequency shifting unit 76 shifts the frequency of the i-th voice component generated in the i-th decoding unit 74 to that of a component within the i-th band. Also, herein, the bandwidths of the first band to the fourth band are the same as each other, and they may not be 4 kHz as in First Embodiment. Also, the voice signal is equally divided into "4" components, but the number of equal divisions is not limited to "4." Also, the sampling frequency in the interpolation unit 64 and the like may be appropriately set. Finally, the combination unit 70 also combines the i-th voice component whose frequency has been shifted in the i-th decoding unit 74 and outputs it.

According to the present embodiment, a voice signal is equally divided into n components and encoding and decoding are executed on each of them, and hence voice quality and clarity can be further improved. Further, a voice signal is equally divided into n components and encoding and decoding are executed on each of them, and hence the flexibility of configuration can be improved.

The present invention has been described above based on embodiments. These embodiments are illustrative in nature, and it should be appreciated by a person skilled in the art that various modifications can be made to the combinations of the components and the processing processes and such modifications also fall within the scope of the present invention.

What is claimed is:

1. An encoding device comprising:

an input unit that inputs a voice signal;

a first encoding unit that generates a first encoded signal by encoding a component within a first band in the voice signal input in the input unit;

a frequency shifting unit that shifts the frequency of a component within a second band in the voice signal input in the input unit, the second band having a frequency higher than that of the first band, to the frequency of a component within the first band;

a second encoding unit that generates a second encoded signal by encoding the component whose frequency has been shifted in the frequency shifting unit; and an output unit that outputs both the first encoded signal generated in the first encoding unit and the second encoded signal generated in the second encoding unit.

2. The encoding device according to claim 1, wherein the output unit alternately outputs the first encoded signal and the second encoded signal.

3. The encoding device according to claim 1, wherein the output unit continuously outputs a plurality of the first encoded signals, and then continuously outputs a plurality of the second encoded signals.

4. The encoding device according to claim 1, further comprising:

an additional frequency shifting unit that shifts the frequency of a component within an i-th (i>2) band in the voice signal input in the input unit, the i-th band having a frequency higher than that of the (i−1)-th band, to the frequency of a component within the first band; and an i-th encoding unit that generates an i-th encoded signal by encoding the component whose frequency has been shifted in the additional frequency shifting unit, wherein the output unit also outputs the i-th encoded signal generated in the i-th encoding unit.

5. A decoding device comprising:

an input unit that inputs both a first encoded signal obtained by encoding a component within a first band in a voice signal and a second encoded signal obtained by shifting the frequency of a component within a second band in the voice signal, the second band having a frequency higher than that of the first band, to the frequency of a component within the first band and then by encoding the latter component;

a first decoding unit that generates a first voice component within the first band by decoding the first encoded signal input in the input unit;

a second decoding unit that generates a second voice component within the first band by decoding the second encoded signal input in the input unit;

a frequency shifting unit that shifts the frequency of the second voice component generated in the second decoding unit to the frequency of a component within the second band; and a combination unit that combines the first voice component generated in the first decoding unit and the second voice component whose frequency has been shifted in the frequency shifting unit and outputs the combined voice component.

6. The decoding device according to claim 5, wherein the input unit alternately inputs the first encoded signal and the second encoded signal.

7. The decoding device according to claim 5 wherein the input unit continuously inputs a plurality of the first encoded signals, and then continuously inputs a plurality of the second encoded signals.

8. The decoding device according to claim 5, wherein the input unit also inputs an i-th (i>2) encoded signal obtained by shifting the frequency of a component within an i-th band in the voice signal, the i-th band having a frequency higher than that of the (i−1)-th band, to the frequency of a component within the first band and by encoding the latter component, and wherein the decoding device includes: an i-th decoding unit that generates an i-th voice component within the first band by decoding the i-th encoded signal input in the input unit; and an additional frequency shifting unit that shifts the frequency of the i-th voice component generated in the i-th decoding unit to the frequency of a component within the i-th band, and wherein the combination unit also combines the i-th voice component whose frequency has been shifted in the additional frequency shifting unit and outputs the combined voice component.

9. A communication system comprising:

an encoding device; and a decoding device, wherein the encoding device includes:

an input unit that inputs a voice signal;

a first encoding unit that generates a first encoded signal by encoding a component within a first band in the voice signal input in the input unit; a frequency shifting unit that shifts the frequency of a component within a second band in the voice signal input in the input unit, the second band having a frequency higher than that of the first band, to the frequency of a component within the first band;

a second encoding unit that generates a second encoded signal by encoding the component whose frequency has been shifted in the frequency shifting unit; and an output unit that outputs both the first encoded signal generated in the first encoding unit and the second encoded signal generated in the second encoding unit, and wherein the decoding unit includes:

an input unit that inputs the first encoded signal and the second encoded signal from the encoding device;

a first decoding unit that generates a first voice component within the first band by decoding the first encoded signal input in the input unit;

a second decoding unit that generates a second voice component within the first band by decoding the second encoded signal input in the input unit;

a frequency shifting unit that shifts the frequency of the second voice component generated in the second decoding unit to the frequency of a component within the second band; and a combination unit that combines the first voice component generated in the first decoding unit and the second voice component whose frequency has been shifted in the frequency shifting unit and outputs the combined voice component.

* * * * *